United States Patent [19]

Cortese

[11] Patent Number: 4,903,415

[45] Date of Patent: Feb. 27, 1990

[54] MACHINE FOR FLAW-CHECKING AND DRYING STOCKINGS AND THE LIKE

[75] Inventor: Carmelo A. Cortese, Via dello Sport 1/4, 40037 Sasso Marconi (Province of Bologna), Italy

[73] Assignee: Carmelo Angelo Cortese, Sasso Marconi, Italy

[21] Appl. No.: 252,969

[22] Filed: Oct. 4, 1988

[30] Foreign Application Priority Data

Oct. 12, 1987 [IT] Italy ..... 3644 A/87
Apr. 14, 1988 [IT] Italy ..... 3411 A/88

[51] Int. Cl.[4] ..... F26B 19/00
[52] U.S. Cl. ..... 34/60; 34/39; 223/60; 223/77
[58] Field of Search ..... 34/39, 219, 60; 269/21; 198/487.1, 604, 803.12; 223/40, 43, 60, 77, 112

[56] References Cited

U.S. PATENT DOCUMENTS 1,841,450 1/1932 Polk et al. ..... 223/77
2,574,621 11/1951 Chun ..... 34/39
4,703,877 11/1987 Kuniki et al. ..... 223/60

*Primary Examiner*—Henry A. Bennet
*Assistant Examiner*—John Sollecito
*Attorney, Agent, or Firm*—Guido Modiano; Albert Josif

[57] ABSTRACT

The machine for flaw-checking and drying stockings and the like comprises a rotatable platform which has elements for supporting stockings, comprising a plurality of vertically arranged fork-like elements each having an elastically contractable base. The platform is actuated intermittently at a station for inserting stockings on the fork-like elements and for checking for the presence of flaws. The fork-like elements are moved into a drying station inside a chamber provided with heating elements, and finally, through a station for removing stockings from the fork-like elements.

12 Claims, 5 Drawing Sheets

MACHINE FOR FLAW-CHECKING AND DRYING STOCKINGS AND THE LIKE

BACKGROUND OF THE INVENTION

The present invention relates to a machine for flaw-checking and drying stockings and the like.

As is known, in some methods of organizing the process of stocking manufacture it is necessary to remove the residual humidity from the stockings as they exit from the dyeing step and to check for the presence of any flaws so as to subsequently perform the packaging of the stockings.

Rather complicated and expensive machines are known for this purpose, their use being in contrast with the characteristics of widespread diffusion of the product. In particular, the visual flaw-checking is performed by means of full-size profiles which are manufactured in transparent material or can be observed from all sides by means of appropriate mirrors. However, the insertion and the removal of the stockings on and from said profiles is difficult.

SUMMARY OF THE INVENTION

The aim of the present invention is to solve the above described problem by providing a machine which allows to perform the flaw-checking and the drying of stockings and the like in an easy and economical manner and furthermore prepares them for the subsequent packaging operations.

Within this aim, a further object of the present invention is to provide a machine which is simple in concept as well as versatile and safely reliable in use.

This aim and this object are both achieved, according to the invention, by the present machine for flaw-checking and drying stockings and the like, which is characterized in that it comprises at least one rotatable platform having means for supporting stockings, constituted by a plurality of vertically arranged fork-like elements, each having an elastically contractable base, said platform being driven intermittently at least at one station for inserting stockings on said fork-like elements and detecting flaws, said machine further comprising at least one drying station located inside a chamber having heating means, and at least one removal station for removing dried stockings from said fork-like elements.

BRIEF DESCRIPTION OF THE DRAWINGS

The details of the invention will become apparent from the detailed description of some preferred embodiments of the machine for flaw-checking and drying stockings and the like, illustrated only by way of non-limitative example in the accompanying drawings, wherein.

DESCRIPTION OF THE PREFERRED EMBODIMENTS

Figure 1:
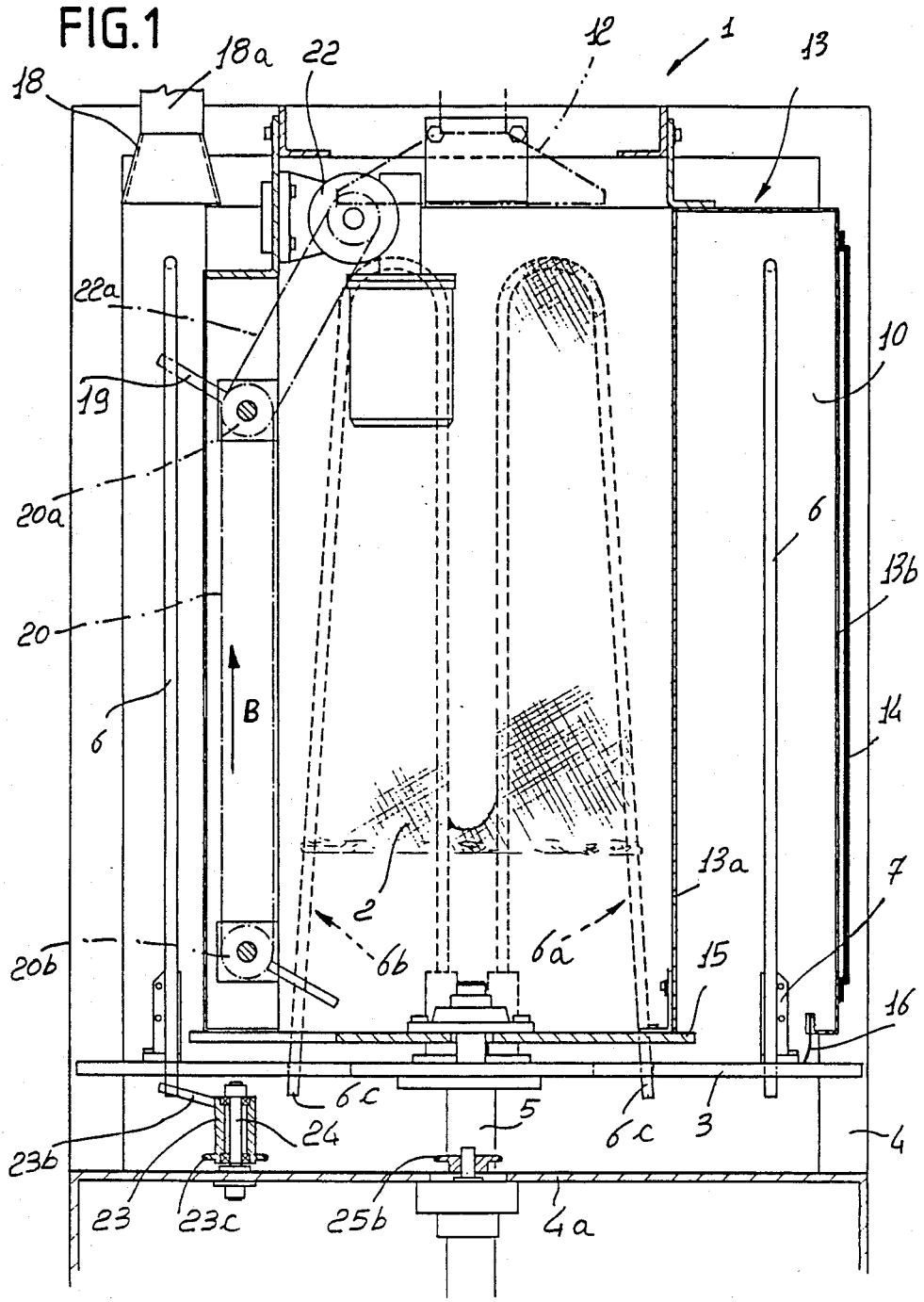
FIG. 1 is a vertical sectional view of the machine according to the invention.
Figure 2:
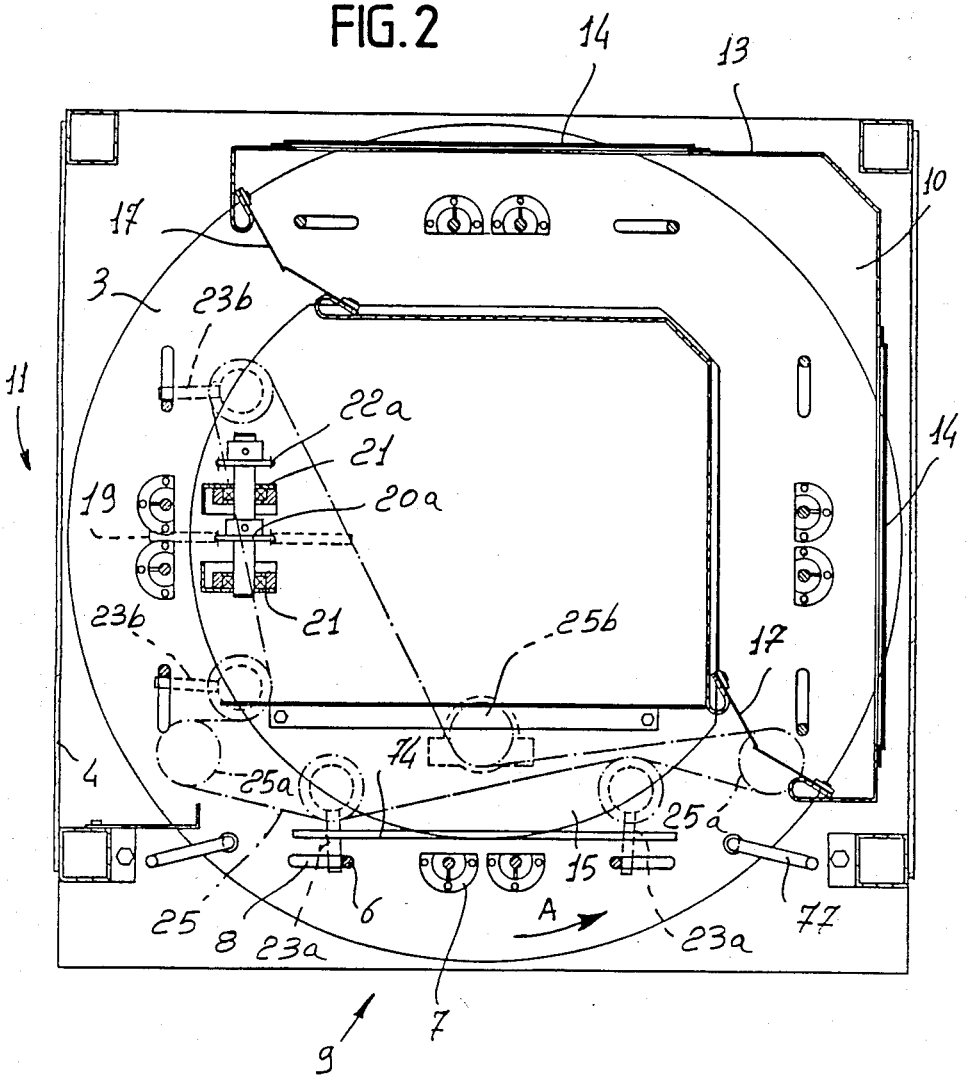
FIG. 2 is a horizontal sectional view thereof.

Initially with reference to FIGS. 1 and 2, the reference numeral 1 generally indicates the machine which allows to perform the flaw-checking and the drying of stockings which in the case illustrated in the drawings are constituted by a conventional pantyhose or pair of stockings 2.

The machine 1 is substantially constituted by a circular platform 3 rotatably supported about a vertical axis on a fixed frame 4. The platform 3 is driven with intermittent rotation, through an appropriate device, by a motor (not shown in the drawing for clarification purposes) which actuates the shaft 5 on which said platform 3 is mounted.

A plurality of fork-like elements 6 adapted to support the pantyhose or stockings 2 is peripherally distributed on the rotatable platform 3. Said fork-like elements 6 are advantageously constituted by shiny metallic tubes, curved in the shape of an inverted U and arranged vertically on planes which are tangent to a circumference which is concentrical to the platform 3. The fork-like elements 6 are each fixed, at one end thereof, onto the platform 3 by means of a related coupling 7, while the other end of each fork-like element is free so that they each define an elastically contractable base; each said free end has a portion 6*c*, which passes through a respective slot 8 provided on the platform 3 and arranged on the plane of said fork-like element.

More in detail, the fork-like elements 6 are mounted in pairs, indicated for the sake of clarity by the reference numerals 6*a* and 6*b*, with the couplings 7 arranged mutually adjacent so as to allow the insertion of both legs of the pantyhose 2. In the illustrated example, four pairs of fork-like elements are provided on the platform 3 and are therefore arranged mutually angularly offset by a right angle, said right angle defining an advancement step of said platform 3. Upon every complete turn of the platform in the direction of the arrow A, the fork-like elements 6 are thus moved to a station for inserting and checking the stockings which is generally indicated by the reference numeral 9; then to a drying station inside a chamber 10 provided with heating means; and finally to a stocking removal station generally indicated by the reference numeral 11.

The insertion and checking station 9 is conveniently upwardly provided with a continuously operating suction element 12 which is adapted to facilitate the insertion of the stockings on the fork-like elements 6.

Figure 3:
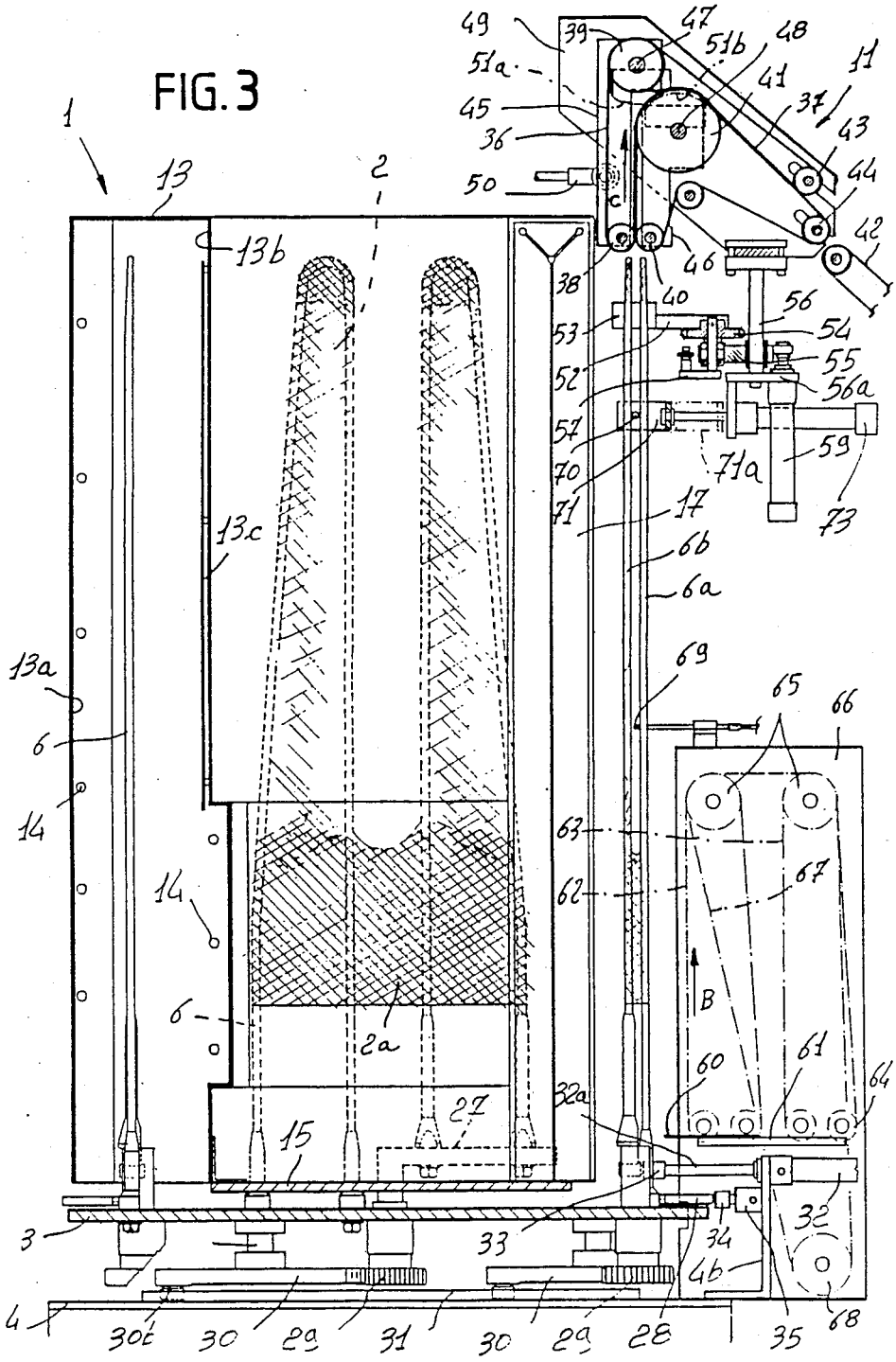
FIG. 3 is a vertical sectional view of the machine in a different embodiment.
Figure 4:
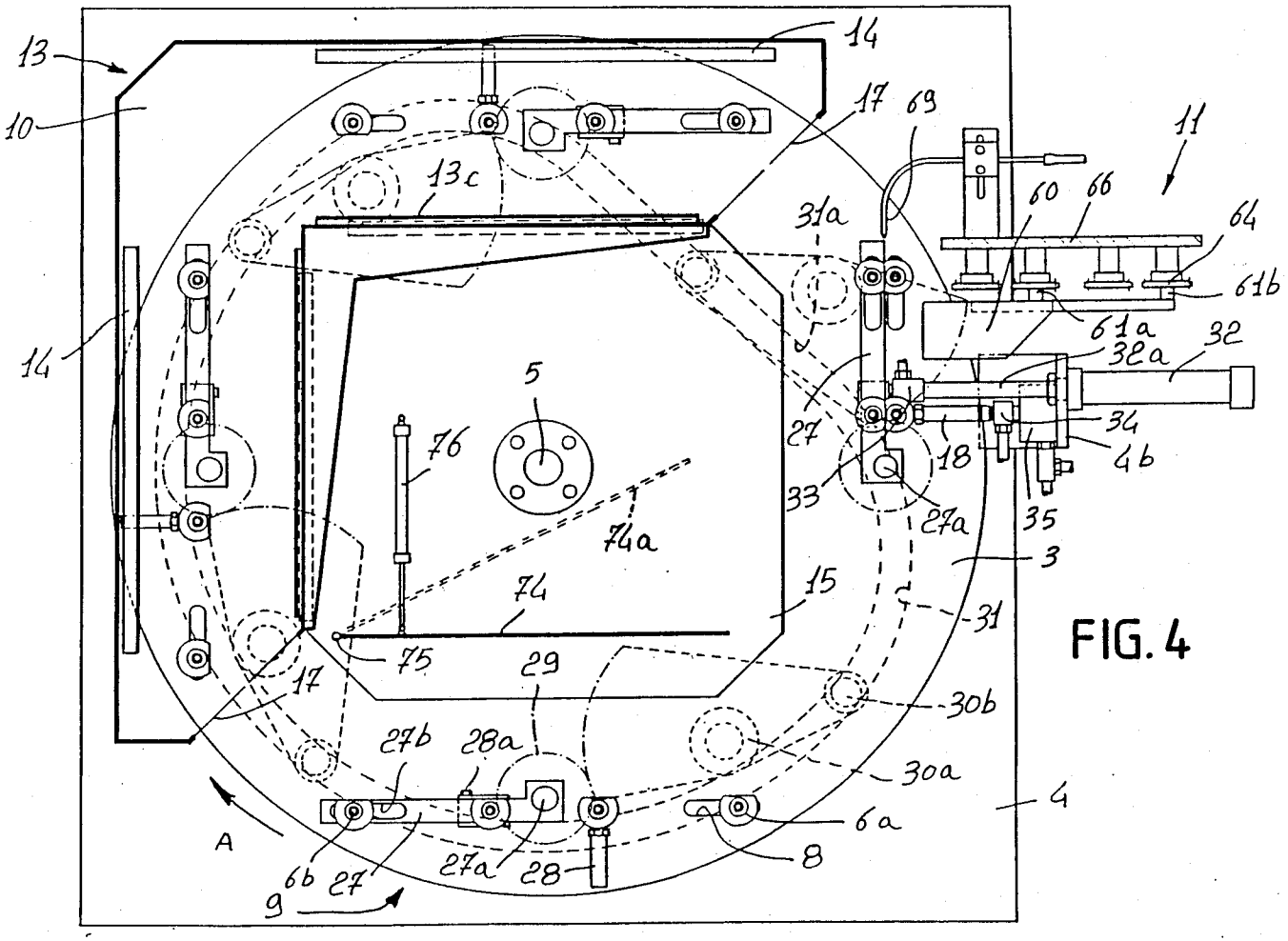
FIG. 4 is a horizontal sectional view of the machine of FIG. 3.
Figure 7:
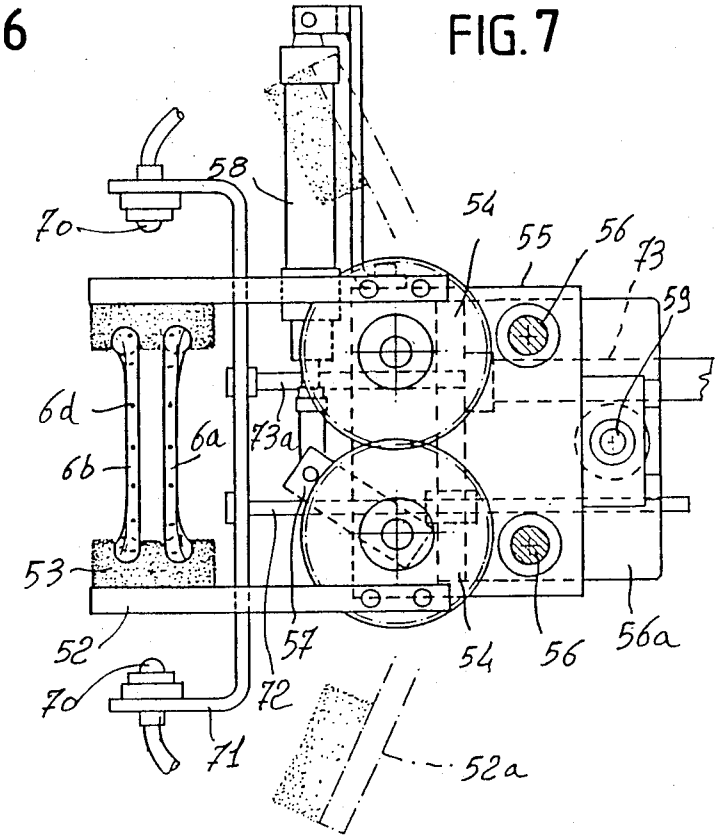
FIG. 7 is a horizontal sectional view of means for gripping the fork-like elements at the removal station.
Figure 6:
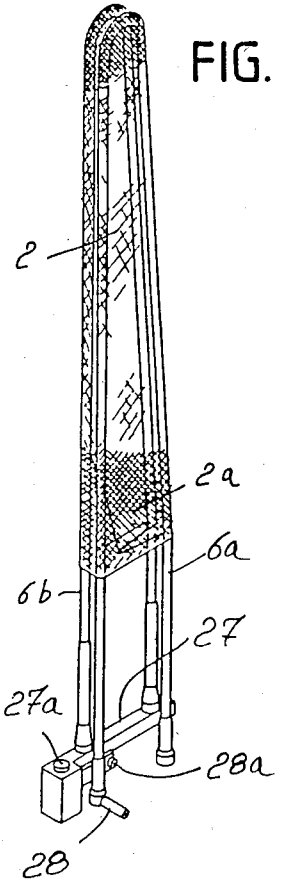
FIG. 6 is a perspective view of a pair of fork-like elements arranged in a mutually facing position.

The drying chamber 10 is constituted by a downwardly open container 13 which avantageously has a substantially L-shaped profile when viewed from above (see FIG. 4), so as to simultaneously accommodate two pairs of fork-like elements 6, respectively spaced apart by one advancement step. A plurality of heating elements, expediently comprising medium-wavelength infrared-ray heating elements 14, is fixed to the walls of the container 13. More precisely, said heating elements are evenly distributed on the outer wall 13*a* of the container, while its inner wall 13*b* conveniently has, at its upper portion, a reflecting surface made of pinchbeck or other suitable material, indicated by the reference numeral 13*c* in FIGS. 3 and 4 and has further heating elements in its lower portion. The inner wall 13*a* of the container 13 is downwardly rigidly coupled to a plate 15 which is rigidly associated with the fixed frame and is arranged coaxially above the platform 3; the outer wall 13*b* is instead downwardly provided with a gasket 16 which is in contact with the platform 3. The front inlet and outlet openings of the chamber 10 further more have closure means such as elastic door-leaves 17 which open upon the passage of the fork-like elements 6.

The removal station 11 is upwardly provided with a further intermittently operating suction element 18 which is intended to eject the stockings through an appropriate duct 18*a*. In order to facilitate the automatic removal of the stockings from the fork-like elements 6 there is a lifting device, mounted on the plate 15, which is constituted by a protuberance 19 which is vertically movable in a middle position with respect to said fork-like elements so as to interact with the panties which join the two legs of the pantyhose. The protuberance 19 is carried by a chain 20 which winds on a pair of toothed wheels 20*a*, 20*b* the axes whereof are rotatably supported between opposite panels 21. The chain 20 is actuated intermittently in the direction of the arrow B, by means of a flexible transmission 22*a*, by a motor 22 fixed to the top of the frame of the machine.

Below the rotatable platform 3, at the insertion station 9 and at the removal station 11 for the stockings 2, there is a device adapted to actuate the tapering of the base of the fork-like elements 6. Said device substantially has a first pair and a second pair of oscillating teeth, indicated by the reference numerals 23*a* and 23*b*, which are respectively arranged at the slots 8 so as to engage the protruding portions 6*c* of the fork-like elements. The teeth 23*a* and 23*b* protrude radially at the top of related sleeves 23 which are rotatably mounted on shafts 24; said shafts 24 extend vertically above a plane 4*a* of the fixed frame. The sleeves 23 define a toothed wheel 23*c* on which a chain 25 is wound and is closed in an annular path which is further defined by appropriate transmission wheels 25*a* and by a pinion 25*b*. By means of this pinion 25*b* the chain 25 is actuated with reciprocating motion by an appropriate motor so as to actuate the alternating angular rotation of the teeth 23*a*, 23*b*.

The operation of the machine is easily understandable from the above description. The operator, standing in front of the insertion and checking station 9, inserts the stockings on the fork-like elements 6, such insertion being facilitated by the suction device 12. In this step the fork-like elements which are at the station 9 are tapered at their base by the teeth 23*a* which are rotated by the chain 25 so as to act on the protruding portions 6*c* of said fork-like elements which are guided within the slots 8. After the insertion, the operator performs the visual checking for the presence of any flaws, rejecting any flawed stockings, which are conveniently classified according to the type of flaw. It should be noted that in this step it is possible to observe both sides of the stockings against reflected light; any flaws occurring in the regions arranged in contact with the fork-like elements being highlighted against the shiny metal.

The stockings mounted on the fork-like elements thus advance within the drying chamber 10, which is heated by the infrared-ray elements 14. Said heating elements switch on only when the platform 3 rotates, in order to avoid an excessively prolonged heating of the stockings. It should be noted that besides the loss of humidity, ironing of the stockings is also achieved during this step.

When they exit from the chamber 10, the stockings are moved to the removal station 11 where the teeth 23*b* are actuated so as to again taper the fork-like elements 6 at their base. The upward motion of the protuberance 19 causes the stockings to rise along the fork-like elements, and said stockings are then expelled through the duct 18*a* by virtue of the actuation of the suction device 18.

Figure 5:
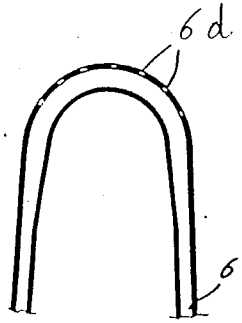
FIG. 5 is a vertical sectional view of the top of a fork-like element.

FIGS. 3–7 illustrate a different embodiment of the machine according to the present invention, wherein the fork-like element 6*a* is fixed to the platform 3, while the fork-like element 6*b* is mounted on an arm 27 which is rotatably supported on said platform by means of a pivot 27*a*. The curved upper portion of the metallic tubes which constitute the fork-like elements is significantly flattened along the vertical plane of arrangmenet of the fork-like element and has a plurality of holes 6*d*, open upwardly as shown in FIG. 5.

More in detail, the fork-like element 6*a* is fixed at one end onto the platform 3, on the side adjacent to the pivot 27*a*, and has its opposite end inserted and locked within a related slot 8 provided on said platform, so as to allow the adjustment of the base width of the fork-like element: the fork-like element 6*b* is in turn fixed at one end onto the arm 27, while its opposite end is adjustably locatable along a slot 27*b* of the arm. At its fixed end, the fork-like element 6*a* has a transverse inlet 28 adapted to be connected to compressed-air delivery means; a similar inlet 28*a* is provided on the arm 27 and is connected to the fixed end of the fork-like element 6*b*.

The pivot 27*a* of the arms 27 which bear the rotatable fork-like elements 6*b* is downwardly provided with a toothed wheel 29 which meshes with a respective toothed sector 30, centrally provided with a fulcrum 30*a* mounted below the platform 3. The toothed sector 30 has a protruding roller 30*b* which is adapted to engage an endless groove cam 31 and is fixed onto the frame 4. The cam 31 has, at the exit of the drying chamber 10, a shaped portion 31*a* which is adapted to cause angular rotation of the rotatable fork-like elements 6*b* as will become apparent hereinafter.

The removal station 11 is downwardly provided with a device for connecting the fork-like elements 6 to the compressed-air delivery which is supported by a bracket 4*b* rigidly associated with the fixed frame of the machine. Said device has a jack 32 which bears, at the end of its stem 32*a*, a terminal 33 connected to said delivery and adapted to couple to the inlet 28*a* arranged on the arm 27 of the fork-like element 6*b*. A terminal 34 actuated by a further jack 35 is similarly intended to couple to the inlet 28 of the fork-like element 6*a*.

Above the fork-like elements 6, the removal station 11 instead has a conveyor device constituted by a pair of belts 36 and 37 which wind on respective pairs of rollers 38, 39 and 40, 41 so as to define adjacent portions arranged on the vertical plane of said fork-like elements. Said adjacent portions of the belts 36, 37 then curve downwards towards a removal belt 42, and said belts wind on further rollers 43, 44. The rollers 38, 39 and 40, 41 are rotatably supported by a pair of supports 45, 46 which are pivoted, at the axes 47, 48 of the rollers 39, 41, to the frame 49 so as to be oscillable on a plane which is vertically perpendicular to the plane of the underlying fork-like elements. The support 45 is actuated to perform its angular motions by a jack 50, which is partially illustrated, and transmits symmetrical rotations to the support 46 by means of a gear with toothed sectors 51*a*, 51*b* which are rigidly associated with said supports.

Below the conveyor device there is a device for gripping the top of the pair of facing fork-like elements 6 which are idle in the station 16; the grip device is constituted by a pair of arms 52 each whereof bears a sponge pad 53. The arms 52 are fixed to respective toothed wheels 54 which mesh with one another and are rotatably supported by a frame 55 which is slideable along a pair of vertical columns 56. One of said toothed wheels 54 is angularly actuated, by means of a crank 57, by a jack 58, supported on a horizontal axis by said frame 55. The frame 55 is slideably actuated with reciprocating motion on the columns 56 by a further jack 59, supported by a plate 56*a* which is fixed to the base of said columns.

In order to facilitate removal of the stockings from the fork-like elements 6 there is a lifting device, arranged outside the platform 3 and substantially constituted by a tooth 60 which is vertically movable between the arms of the two facing fork-like elements, so as to interact with the panties 2*a* which join the two legs of the pantyhose. The tooth 60 is fixed to a bar 61 which is moved along a significantly rectangular path by a pair of chains 62, 63 which wind respectively on a pair of lower toothed wheels 64 and on an upper toothed wheel 65; the bar is articulated, respectively at 61*a*, and 61*b*, to the chains 62, 63. The toothed wheels 64 and 65 are arranged co-planar and rotatable with horizontally parallel axes on a vertical plate 66 rigidly associated with the fixed frame. The portions of the chains 62, 63 which are directed towards the mutually facing fork-like elements are intended to move in the direction of the arrow B by means of a chain transmission 67 which receives its motion from a driving wheel 68 which is in turn actuated by an appropriate motor.

The plate 66 furthermore supports a nozzle 69 having a horizontal axis and adapted to be connected to the compressed air delivery. As better indicated hereinafter, the nozzle 69 is arranged on a middle plane with respect to the facing fork-like elements 6*a*, 6*b* on the opposite side with respect to the folding side of the panties 2*a*.

A pair of further nozzles 70 is conveniently arranged horizontally coaxial and opposite and is adapted to be similarly connected to the compressed-air delivery. The nozzles 70 are supported, below the device for gripping the top of the facing fork-like elements, by a bracket 71 which is slideably mounted on a guide 72 which is fixed to the plate 56*a* on an axis which is horizontally transverse to the plane of the facing fork-like elements. The stem 73*a* of a jack 73 which is in turn supported by the plate 56*a* is rigidly associated with the bracket 71; the jack 73 is adapted to actuate the movement of the bracket 71 between an active position, wherein the nozzles 70 are arranged on the middle plane with respect to the facing fork-like elements, and a disengaged position illustrated in broken lines and indicated by the reference numeral 71*a* in FIG. 3.

The insertion station 9 is furthermore faced by a vertical luminous panel 74 intended to facilitate the checking operation; the luminous panel 74 is rotatable on a lateral fulcrum 75 by virtue of the action of a jack 76 having a horizontal axis.

The machine finally has (as shown in FIG. 2) a pair of safety handles 77 having appropriate sensors and adapted to lock the rotation of the platform 3 when the hands of the operator are between the fork-like elements 6 and the fixed frame.

Also in this case the operation of the machine provides the insertion of the stocking 2 on the fork-like elements which are idle at the station 9, the visual checking for the presence of any flaws and the successive advancement of the stockings mounted on the fork-like elements within the drying chamber 10, which is heated by the infrared-ray elements 14. It should be noted that the presence of the elements 14 both on the wall 13*a* and on the wall 13*b* corresponds to the panties 2*a* of the pantyhose.

Upon their exit from the chamber 10, the stockings move to the removal station 11. During this passage the portion 31*a* of the groove cam 31 actuates the rotation of the arm 27 which bears the fork-like element 6*b*. The arm 27 rotates through half a circumference about the pivot 27*a* so as to move the fork-like element 6*b* against the fixed fork-like element 6*a*, with the folded protion of the panties 2*a* directed forwardly in the direction of advancement A.

The step of removal of the stockings initially provides the extraction of the stems from the jacks 32, 35 until the terminals 33, 34 couple to the inlets 28, 28*a*. This is followed by the delivery of compressed air inside the fork-like elements; the arms 52 are simultaneously actuated so that the sponge pads 53 lock the fork-like elements (see FIG. 7) and the spacing of the supports 45 and 46 which bear the belts 36 and 37 is actuated. Thus the ends of the stockings are tensioned upwards by the jet of compressed air exiting from the holes 6*d* of the fork-like elements and are inserted between the portions of the belts 36 and 37 which are vertically adjacent and correspondingly spaced apart. The lifting of the end of the stockings is accompanied by the upward movement of the grip arms 52 which is actuated by the jack 59 which actuates the sliding of the frame 55.

Then the closure of the belts 36, 37 is actuated by means of the jack 50 so as to lock the tensioned end of the stockings between the adjacent portions which continuously unwind in the direction indicated by the reference signal C; the transport performed by the belts causes the removal of the stockings from the fork-like elements. The simultaneous actuation of the tooth 60, which inserts into the fork-like elements below the panties 2*a*, causing them to rise along said fork-like elements, cooperates to this removal. In this step the grip arms 52 are returned to their spaced position 52*a* (FIG. 7) by the jack 58 and to their lowered position by the jack 59.

Figure 8B:
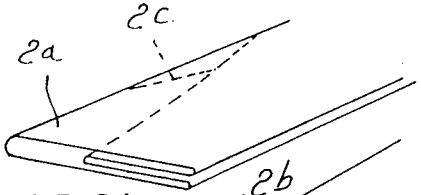
FIGS. 8*a* and 8*b* finally are respective perspective views of the stockings in various folding steps.
Figure 8A:
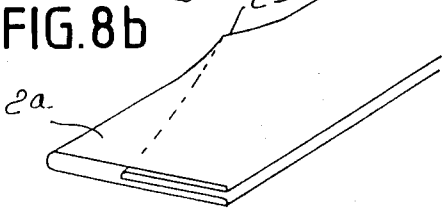

When the panties 2*a* reach the nozzle 69, a conventional sensor, not illustrated, actuates the delivery of compressed air. A jet directed between the folded portions of the panties is thus ejected from the nozzle 69 and keeps said portions tensioned. In particular the panties 2*a* assume the folded configuration shown in FIG. 8*a*.

Conveniently, when the panties 2*a* reach the further nozzles 70, which are moved to their operating position by the jack 73, the delivery of compressed air is actuated so as to direct opposite jets between the folded portions of said panties. This allows to perform the folding of the flap 2*b* of the panties (see FIG. 8*a*) which protrudes with respect to the preceding folding line, as is clearly shown in FIG. 8*b*, wherein the reference numeral 2*c* indicates the folded flap. The nozzles 70 are subsequently moved to their disengagement position 71*a* (FIG. 3) to allow the advancement of the fork-like elements 6.

Once the removal of the stockings is completed, the stockings are sent to be packaged along the belt 42 and the fork-like elements again move to the initial insertion and checking station 9 for the successive work cycle. During this passage, the cam 31 actuates the return of the movable fork-like element **6*b* to the position which is co-planar and adjacent with respect to the fixed fork-like element 6*a*. It should be noted that the rotation of the luminous panel 74 to position 74*a*** is actuated in this step so as to allow the opening movement of the fork-like elements.

The described machine thus allows to perform the visual checking of stockings in a simple manner, rejecting those having any flaw, during the drying cycle. Said drying is effectively performed by conventional infra-red-ray heating elements which cooperate with the pinchback reflecting surfaces. The fact is particularly stressed that during the removal step the machine performs a partial folding of the stockings which facilitates the subsequent packaging operations.

In the practical embodiment of the invention, the materials employed, as well as the shapes and diemsnions, may be any according to the requirements.

I claim:

1. Machine for flaw-checking and drying stockings, pantyhose and like articles, comprising at least one rotatable platform, a plurality of vertically arranged fork-like elements mounted on said platform for supporting the articles, at least one insertion and inspection station for inserting the articles on said fork-like elements and for detecting flaws thereon, means for intermittently driving said platform to cause said fork-like elements to temporary face said insertion and inspection station, at least one drying station including a chamber internally provided with with heating means, and at least one removal station for removing dried articles from said fork-like elements, wherein said fork-like elements have an elastically contractable base to facilitate insertion and removal of articles, said drying station being located on part of said platform and said heating means comprising infrared-ray elements, and wherein said heating means are activated only during the rotation of said platform.

2. Machine for flaw-checking and drying stockings, pantyhose and like articles, comprising at least one rotatable platorm, a plurality of vertically arranged fork-like elements mounted on said platform for supporting the articles, at least one insertion and inspection station for inserting the articles on said fork-like elements and for detecting flaws thereon, means for intermittently driving said platform to cause said fork-like elements to temporary face said insertion and inspection station, at least one drying station including a chamber internally provided with heating means, and at least one removal station for removing dried articles from said fork-like elements, wherein said fork-like elements have an elastically contractable base for facilitating insertion and removal of the articles, said drying station being located on part of said platform, said heating means comprise infrared-ray elements, and wherein said fork-like elements are constituted by metallic tubes, folded in the shape of an inverted U and arranged vertically along planes tangent to a circumference which is concentrical to said platform, said tubes being connectable with compressed-air delivery means and having an upper curved portion significantly flattened along a vertical plane of arrangement of said fork-like element and provided with a plurality of upwardly directed holes.

3. Machine for flaw-checking and drying stockings, pantyhose and like articles, comprising at least one rotatable platform, a plurality of vertically arranged fork-like elements mounted on said platform for supporting the articles, at least one insertion and inspection station for inserting the articles on said fork-like elements and for detecting flaws thereon, means for intermittently driving said platform to cause said fork-like elements to temporary face said insertion and inspection station, at least one drying station including a chamber internally provided with heating means, and at least one removal station for removing dried articles from said fork-like elements, wherein said fork-like elements have each an elastically contractable base for facilitating insertion and removal of the articles, said fork-like elements being formed of metallic tubes folded in the shape of an inverted U and being arranged vertically along planes tangent to a circumference which is concentrical to said platform, means being provided for connecting said tubes with compressed-air delivery means, said tubes having upper curved portions which are substantially flattened along said vertical plane of arrangement of said fork-like elements and are provided with a plurality of upwardly directed holes, said drying station being located on part of said rotatable platform and having said heating means consisting of infrared-ray elements, which are actuatable only upon rotation of said platform.

4. Machine according to claim 3, wherein said means for connecting said tubes with compressed-air delivery means comprise inlet ports provided at the lower end of said fork-like elements, and a pair of fixed jacks arranged at said removal station in communication with said compressed-air delivery means, said jacks having stems with terminal fittings arranged at the end portion thereof for coupling with said inlet ports upon activation of said jacks.

5. Machine according to claim 1, wherein said fork-like elements are vertically mounted on said platform in adjacent pairs angularly offset from each other for fitting over the articles, one of the elements of said pairs being rotatable about a vertical axis to move between a first position, in substantial alignement with the other element, and a second position, in facing relationship with said other element to define a middle vertical plane therebetween, means being provided for actuating, at the exit of said drying chamber, the angular rotation of said rotatable element from said first to said second position to thereby cause folding of an article fitted on said adjacent fork-like elements along a vertical line proximate to said rotation axis of said movable element.

6. Machine according to claim 5, wherein said means for actuating the rotation of said movable fork-like element comprise a fixed endless cam extending in a plane substantially parallel to said platform, a roller received and guided within said endless cam and carried by a toothed sector, said toothed sector being pivotally mounted downwardly of said platform and meshing with a toothed wheel, said toothed wheel being pivoted to said platform and being coaxially fixed to a supporting arm bearing said rotatable fork-like element.

7. Machine according to claim 3, wherein said drying chamber comprises a container having an outer wall and an inner wall, an upper portion and a lower portion, said container being so shaped to simultaneously receive two pairs of fork-like elements reciprocally spaced by one angular step of said platform, a part of said heating means being substantially uniformly distributed on said outer wall, said inner wall having, on the upper portion thereof, a pinchbeck reflecting surface and, on the lower portion thereof, a further part of said heating means.

8. Machine according to claim 5, wherein said removal station comprises a single nozzle connected with a source of compressed air, said single nozzle having an horizontal axis and being arranged on said middle vertical plane of said fork-like elements in their facing position, on the opposite side with respect to the folding side.

9. Machine according to claim 5, wherein said removal station further comprises a pair of horizontal and coaxial nozzles which are directed in opposite direction and are connected with said source of compressed air, said pair of nozzles being respectively mounted on brackets movable along a substantially horizontal axis extending transversly of said vertical arrangement plane of said fork-like elements, said brackets being arranged for reciprocating movement between an operative position wherein said nozzle are substantially aligned with said middle plane of said fork-like element in their facing position, and an inoperative position wherein said nozzles are out of alignment with said arrangment plane of said fork-like element.

10. Machine according to claim 5 wherein said removal station further comprises a conveyor device for upwardly conveying folded articles, said conveyor device including a pair of endless belts disposed above said fork-like elements, said endless belts winding on respective series of guiding rollers, said guiding rollers being so arranged to define on said endless belts at least two adjacent conveying portions extending along said vertical plane of arrangement of said fork-like elements in their facing position, said series of rollers being so laterally supported to permit oscillation of said conveying portions with respect to said vertical arrangment plane, means being provided for alternatively spanning and moving closer said conveying portions to thereby cause the articles to be taken off and upwardly conveyed therebetween.

11. An appartus according to claim 9, wherein said removal station further comprises a gripping device for gripping the top poriton of a folded article fitted on a pair of fork-like elements in their facing position, said gripping device being located between and above said pair of coaxial nozzles and comprising a vertically slidable frame, a pair of arms pivotally supported on said frame, a sponge pad fixed to said arms proximately to the free end portion thereof, actuating means for spanning and moving closer said arms to thereby respectively engage or disengage the top portion of a folded article fitted on said fork like-elements in their facing position.

12. Machine according to claim 5, wherein said removal station further comprises a lifting device, said lifting device including a tooth vertically movable along said middle vertical plane of said fork-like elements in their facing position, said tooth being arranged to interengage, during ascending movement thereof, with a folded article fitted on said fork-like elements, said tooth being moved by a pair of endless chains extending in a vertical plane substantially perpendicular to the plane of said fork-like elements and arranged to cause the movement of said tooth along a substantially rectangular path.

* * * * *